United States Patent [19]

Gueussier et al.

[11] Patent Number: 4,555,265

[45] Date of Patent: Nov. 26, 1985

[54] METHOD OF TREATING STEEL WITH CALCIUM, TO OBTAIN A STEEL WELL ADAPTED TO COLD FORMING, WITH A LOW SILICON CONTENT

[75] Inventors: André Gueussier, Paris; Edmond Vachiery, Solesmes, both of France

[73] Assignee: Vallourec, Paris, France

[21] Appl. No.: 648,821

[22] Filed: Sep. 10, 1984

[30] Foreign Application Priority Data

Sep. 20, 1983 [FR] France ..... 83 15191

[51] Int. Cl.[4] ..... C21C 7/02

[52] U.S. Cl. ..... 75/53; 75/58

[58] Field of Search ..... 75/53, 58

[56] References Cited

U.S. PATENT DOCUMENTS 3,841,616 10/1974 Rocher ..... 75/53

4,094,666 6/1978 Ototani ..... 75/53

*Primary Examiner*—Peter D. Rosenberg

*Attorney, Agent, or Firm*—McDougall, Hersh & Scott

[57] ABSTRACT

The invention concerns the production of steels which have an isotropic structure, are very well adapted to cold forming particularly by pressing and which have a very low silicon content.

The method comprises taking a deoxidated liquid steel with a low silicon content and placing in it a cored wire containing a divided material, which is a mixture of silico-calcium and granular calcium in a specific quantity and specific proportions.

The method is applicable to non-alloyed or slightly alloyed steels and is particularly suitable for a continuous casting installation.

11 Claims, 1 Drawing Figure

Figure 1:
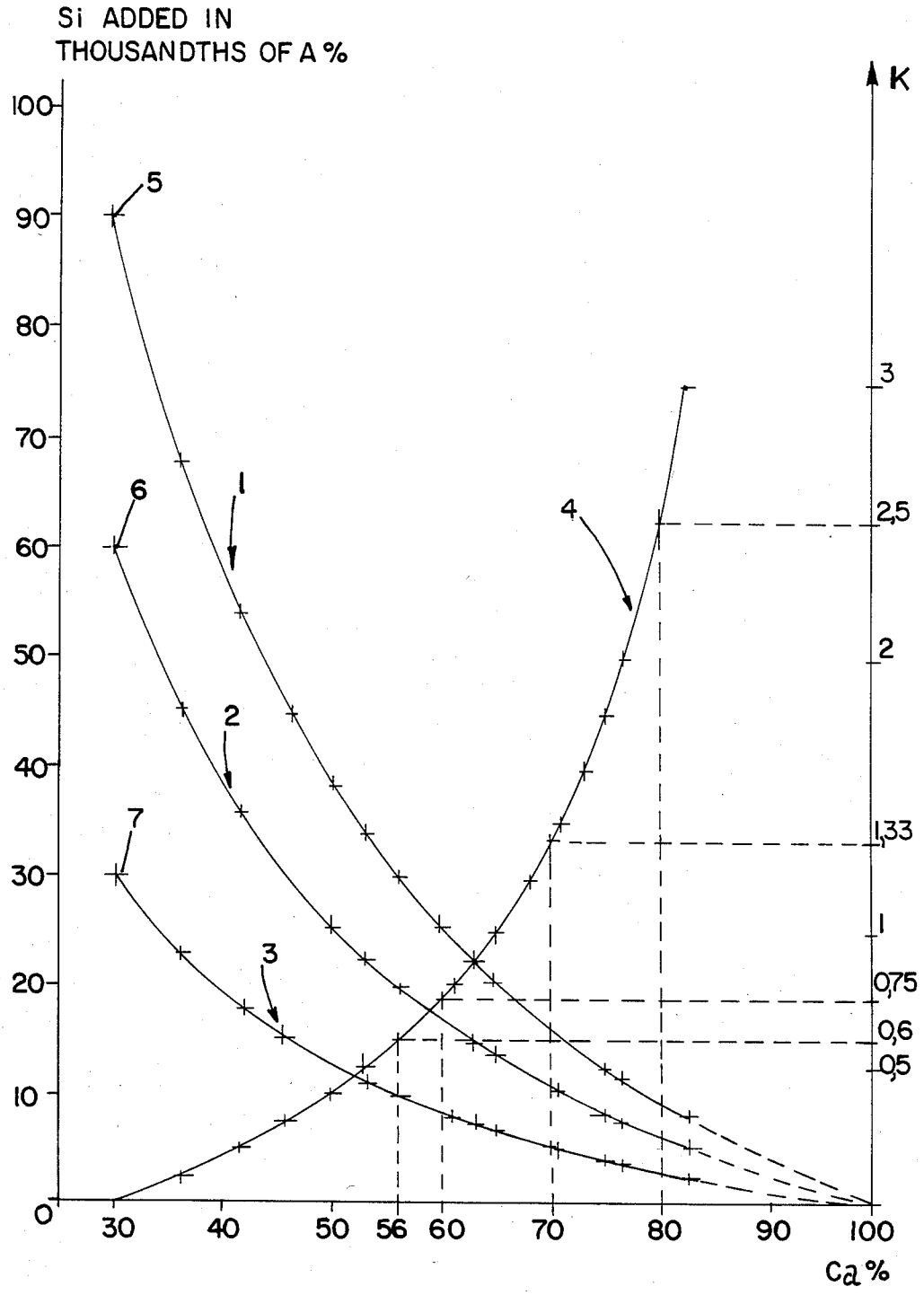

METHOD OF TREATING STEEL WITH CALCIUM, TO OBTAIN A STEEL WELL ADAPTED TO COLD FORMING, WITH A LOW SILICON CONTENT

The method of the invention concerns steels in which the inclusions remain globular after rolling as a result of an appropriate treatment; this gives them particularly important properties in the state of use, such as greater suitability for pressing (emboutissabilite) or cold stamping.

In the preparation of such steels it is known to add calcium to the liquid steel before casting it.

The addition of this element to the liquid steel presents special difficulties due its low density and very strong tendency to oxidation.

A particularly effective method of adding the calcium is described in European patent application EP No. 34994 page 8, lines 13–35.

It comprises using a silico-calcium containing 30% of calcium; the alloy is used in the form of a powder enveloped in thin steel sheath, which is compacted in situ. The resultant composite product, commonly known as "cored wire", is introduced by unwinding it from a bobbin inside the bath of liquid steel to be treated. This avoids any oxidation of the active element, the calcium, and this acts directly on the metal bath, with a yield which is high and reproducible.

Steels thus treated have improved properties in many fields: isotropy, ductility, machinability. Moreover the addition of calcium liquefies the inclusions present in the liquid metal and thus avoids the danger of blocking nozzles used for continuous casting.

However, the method cannot be used when certain steels have to be prepared, with a particular aptitude for cold forming and more particularly deep drawing (emboutissage profond).

Steels of this type must have a very low silicon content. The limit which must not be exceeded is usually from 20 to 30 thousandths of a % of silicon. In practice the silico-calcium used contains about 30% of Ca, 60% of Si and 10% of Fe+various impurities.

The weight of silico-calcium that has to be added to the liquid steel in order to make the calcium fully effective is about 0.5 to 1.5 kg per tonne of liquid steel.

This increases the silicon content of the liquid steel by 30 to 90 thousandths of a %, with a yield of virtually 100%.

Tests have shown that it is not desirable to use silico-calcium containing more than 30% of calcium. As a matter of fact these alloys in the ground state are unstable and liable to explosion. There are similar dangers of explosion in the case of ground calcium containing large proportions of fines, which are extremely unstable and liable to oxidation.

It is known to be possible to produce a pure calcium in granular form without any fines. A product of this type can be obtained particularly by the method described in international PCT application No. W081/01811. Its use can therefore be considered for the production of steels with a very low silicon content.

However, this product has the disadvantage of high cost, which greatly raises the cost of refining such steels.

Research has therefore been done on the possibility of producing steels at a much more favourable manufacturing cost; the steels must contain calcium and a very small quantity of silicon so that particularly advantageous properties can be obtained, particularly such as that of cold deformability.

The method of the invention comprises producing a liquid steel with a very small silicon content in known manner, then placing a cored wire in the liquid steel, the cored wire having a sheathing which is generally made of steel and the core of which is a divided material comprising at least two constituents. The first constituent is metallic granular calcium in which the content of particles smaller than 150 mesh is not more than 2 to 3% by weight of said constituent.

The second constituent is silico-calcium containing, as % by weight, Ca 25 to 35, Si 50 to 70, Fe and impurities 5 to 15.

The weight ratio K, of the first constituent to the second constituent of the divided material, is from 0.1 to 3.

The quantities of calcium and silicon generally added to the liquid steel by means of the cored wire are approximately 125 to 600 g of calcium and not more than 300 g of silicon per tonne of steel treated.

The liquid steel is preferably produced in such a way that its silicon content before the introduction of the cored wire is less than 5 thousandths of a % by weight.

When the liquid steel has been killed with aluminium it may in particular be treated with a reducing basic slag, containing e.g. fluorspar, in order to desulphurise it.

The cored wire advantageously has a core of divided material which is in the compacted state inside the sheathing, the sheathing having at least two parallel flattened zones facing one another. The granular calcium used is preferably obtained by the method of international PCT application No. WO 81/01811.

The method comprises melting the initial calcium and passing it in the divided state through a purifying bath, then after decantation pulverising it by passing it through a vibrating orifice, and finally solidifying the drops obtained into grains.

The method of the invention can generally be applied to the production of non-alloyed or slightly alloyed steels.

Generally speaking the method of the invention provides a particularly economic way of adding calcium to a steel at the concentration desired to globularise the inclusions, while keeping the silicon content below a limit which is usually set by a standard.

The steel thus obtained not only has the normal properties of steels treated with calcium, particularly good isotropic properties; it also has mechanical properties, excellent suitability for machining and also excellent suitability for cold deformation and more particularly pressing (emboutissage).

The method of the invention enables the cost of producing these steels to be greatly reduced. For this purpose the total quantity of calcium that has to be added to the steel by means of a cored wire is first determined, taking into account the fact that the yield from reacting the calcium thus introduced is 15 to 20%.

The quantities of silicon that can be included in the steel without exceeding the acceptable maximum limit are also determined.

This limit is usually about 20 to 30 thousandths of a %. To the extent that the production of the steel has resulted in a liquid steel with a very low silicon content, e.g. below 5 thousandths of a %, one can accept an increase in the silicon content of the steel, in the course of the introduction of the cored wire into the liquid steel, of about 15 to 30 thousandths of a % according to the specifications that the steel has to comply with. Thus taking into account its initial silicon content and the specified limit, 150 to 300 g of silicon may be added to the steel per tonne of liquid steel. When the silicon is introduced in the form of a silico-calcium of the normal type, containing approximately 60% Si, 30% Ca and 10% Fe+impurities (by weight), it will be seen that the total quantity of silico-calcium to be introduced will be from 250 to 500 g per tonne of liquid steel. The corresponding quantity of calcium thus introduced will be from 75 to 150 g per tonne. In order to obtain the total amount of calcium that has to be added it is sufficient to mix the complementary quantity of granular calcium with the silico-calcium. The cost of producing such steels can thus be minimised. On the one hand the largest possible quantity of a silico-calcium is used, with a particularly low manufacturing cost per unit of calcium introduced, and on the other hand use of pure calcium instead of silico-calcium for the complementary amount reduces the total weight and corresponding volume of divided material to be introduced.

This means that, given an equal section and an equal compacting rate, a shorter length of cored wire has to be put in the bath of liquid steel, thus also helping to reduce costs. The wire will generally be added in the transporting vessel or in the distributor in the case of continuous casting. The steel will have been deoxidated in a preliminary step, under conditions which bring down its silicon content to a level generally below 5 thousandths of a % and generally about 1 to 3 thousandths of a %.

The invention also relates to a cored wire for treating baths of steel, comprising a metal sheathing inside which a divided material is enclosed, based on calcium and silicon. The divided material has at least two constituents, the first being metallic granular calcium where the content of particles smaller than 150 mesh is not more than 2 to 3% by weight of said constituent, and the second constituent being silico-calcium containing (as % by weight) Ca 25 to 35%, Si 50 to 70%, Fe and impurities 5 to 15%, the ratio K of the content of the first constituent to that of the second being from 0.1 to 3 and preferably from 0.3 to 2.

Sheathing of the cored wire according to the invention is advantageously made of steel.

It is also advantageous for the divided material enclosed in the sheathing to be in the compacted state. A particularly important embodiment of the cored wire is a wire where the sheathing has at least two parallel flattened zones facing one another.

The accompanying drawing will throw light on the possibilities of the method of the invention and its application.

The y-axis of the FIGURE gives the enrichment of the metal with silicon resulting from injection of the cored wire, as a function of the mean calcium content of the mixture used.

The FIGURE has three curves (1) (2) and (3), each corresponding to a constant quantity of calcium added to the tonne of steel 450 g/tonne for curve (1)
300 g/tonne for curve (2)
150 g/tonne for curve (3).

The mixtures are made up of pure granular calcium without any fines (no particles smaller than 100 microns in diameter) and a ground silico-calcium containing, as % by weight: Si 60%—Ca 30%—Fe and impurities 10%.

The x-axis gives the total calcium content, as a % by weight, of calcium/silico-calcium mixture at each point of the curves. This content may be calculated from the ratio K, of the quantity of pure calcium to that of silico-calcium contained in the mixtures at each point. The curve (4) shows the variation in the total calcium content of the mixtures as a function of the ratio K.

The value K=0 corresponds to a divided material made up solely of silico-calcium with 30% calcium. It defines the starting points (5), (6) and (7) for each of the curves (1), (2) and (3).

At each of these points the divided material respectively comprises 1.5, 1 and 0.5 kg of silico-calcium without any pure calcium added. The corresponding quantities of silicon which will be added to the liquid steel are: 900 g, 600 g and 300 g of silicon per tonne. Since the yield from the introduction of the silicon is virtually 100%, it will be seen that these additions of silico-calcium enrich the steel with silicon at these points by 90, 60 and 30 thousandths of a % respectively. Such degrees of enrichment are not acceptable if the final content of silicon is to be restricted to a level e.g. below 30 thousandths or even below 25 or 20 thousandths of a %.

The curves in the FIGURE show that the silicon content can be reduced to the desired level by moderately enriching the divided material with pure calcium. It will be found, for example, that a mixture of divided material with a K ratio of 0.6, that is to say, one in which the weight of pure calcium is equal to 60% of the weight of silico-calcium, enables the enrichment with silicon to be divided by three, all other things being equal. A mixture of this type contains 56% of Ca instead of 30% in the case of the silico-calcium alone, and the weight necessary to treat one tonne of liquid steel is only 53.6% of the initial weight.

In many cases the desired result can be obtained by increasing the quantity of calcium in the divided material by a relatively small amount.

In the divided materials used in the invention the K ratio may range from 0.1 to 3 according to requirements. In practice one is generally restricted to K ratios of from 0.2 to 2. It is preferable to try to use the lowest possible K ratios, dependent on the application, so as to minimise the cost of the addition.

The following example describes an embodiment of the method of the invention in a non-restrictive way.

(1) A steel for pressing (emboutissage) is produced in known manner by means of an LD converter. After being cast in a transporting vessel (poche) coated with dolomite the steel is of the following composition (as % by weight):

C=0.055; Si=0.004; Mn=0.280; S=0.012; P=0.014; Cu=0.015.

It is killed with aluminium in the transporting vessel without any ferro-silicon being added. The steel is treated in the vessel with a basic slag comprising a mixture of calcium aluminate (chaux d'alumine)asd fluorspar, and is agitated by blowing argon through a porous plug placed in the bottom of the vessel. After 10 minutes' blowing the composition of the steel is as follows (% by weight):

C=0.057; Si=0.003; Mn=0.290; S=0.008; P=0.017; Cu=0.016 and Al=0.045.

A cored wire with steel sheathing is then placed in the liquid steel. The divided material contained in it is a silico-calcium containing the following (as % by weight) Ca=30, Si=60, Fe and impurities 10. The quantity of silico-calcium introduced is 1.2 kg (corresponding to 0.36 kg of calcium) per tonne of liquid steel. When argon has been blown through for 3 minutes the steel is cast in ingots, which are then converted to blooms. The mean composition of the blooms is then as follows (% by weight):

C=0.058; Si=0.076; Mn=0.290; S=0.006.

(2) A steel for pressing is produced by the method of the invention; it is of the same gradation, for which a silicon content of less than 0.020% is specified. When the steel has been produced in the LD converter, then killed with aluminium and treated with a basic slag, with argon being blown through as in the first case, the following composition is obtained:

C=0.055; Si=0.016; Mn=0.270; S=0.005; P=0.015; Cu=0.019; Al=0.035; Ca=0.0040.

A cored wire with steed sheathing is then placed in the liquid steel; the divided material contained in it is a mixture of silico-calcium of the same composition as in the first example, and pure granular calcium. The K ratio is 1.33, corresponding to a divided material with a mean calcium content of 70%.

The total quantity of calcium added is the same as in the first case, that is to say, 360 g per tonne of liquid steel to be treated. This time the mixture of divided material contains 294 g of pure granular calcium and 221 g of silico-calcium, containing only 132 g of silicon. The weight of mixture to be introduced is brought down to 515 g/tonne instead of 1200 g/tonne thus greatly reducing the length of cored wire.

When argon has been blown in for 3 minutes, the steel is cast in ingots and these are converted to blooms, which are of the following mean composition (as % by weight):

C=0.055; Si=0.016; Mn=0.270; S=0.005; P=0.015; Cu=0.019; Al=0.035; Ca=0.0040.

The steel obtained by the method of the invention is thus as specified relative to the silicon content. It has a substantially isotropic structure and is well adapted to pressing (emboutissage).

The method of the invention may be modified in many ways without going beyond its scope.

In particular the invention makes it possible to determine in each case what are the optimum quantities of calcium and silico-calcium to be used in order to obtain a steel for pressing under the most economic conditions.

The invention is particularly applicable to continuous casting of steels. In this case the cored wire for the above treatment may be injected either in the transporting vessel or in the distributer.

I claim:

1. A method of producing a steel well-adapted to cold forming, comprising preparing a deoxidated liquid steel having a silicon content of less than 5 thousandths of a % by weight, then adding a cored wire containing a divided material to the liquid steel, wherein the divided material has at least two constituents, the first being granular metallic calcium, in which the content of particles smaller than 150 mesh is not more than 2 to 3% by weight of said constituent, and the second being silico-calcium containing (as % by weight): Ca 25 to 35; Si 50 to 70; Fe and impurities 5 to 15, ratio K of the content of the first constituent to that of the second being from 0.1 to 3 and preferably 0.3 to 2.

2. The method of claim 1, characterised in that the sheathing of the cored wire is made of steel.

3. The method of claim 1 or 2, characterised in that the quantity of calcium and silicon added to the steel by means of the cored wire is: from 125 to 600 g of calcium per tonne of steel treated and not more than 300 g of silicon per tonne of steel treated.

4. The method of claim 3, characterised in that before the introduction of the cored wire the steel has been killed with aluminium then treated with a reducing basic slag.

5. The method of claim 4, characterised in that the cored wire has a core of divided material compacted inside the sheathing, and that the sheathing has at least two parallel flattened zones facing one another.

6. The method of claim 5, characterised in that the granular calcium which is one of the constituents of the divided material is obtained by melting the initial calcium, passing the molten calcium in the divided state through a purifying bath, decanting the calcium, pulverising the decanted calcium by passing it through a vibrating orifice, and finally solidifying the drops of calcium thus formed into grains.

7. The method of claim 6, characterised in that the cored wire is introduced in the distributor or in the transporting vessel of a continuous casting installation.

8. Cored wire for treating baths of steel, comprising a metal sheathing inside which a material based on calcium and silicon is enclosed, characterised in that the divided material has at least two constituents, the first being granular metallic calcium, in which the content of particles smaller than 150 mesh is not more than 2 to 3% by weight of said constituent, and the second being silico-calcium containing (as % by weight): Ca 25 to 35; Si 50 to 70; Fe and impurities 5 to 15, the ratio K of the content of the first constituent to that of the second being from 0.1 to 3 and preferably 0.3 to 2.

9. The cored wire of claim 8, characterised in that the sheathing of the cored wire is made of steel.

10. The cored wire of claim 8 or 9, characterised in that the divided material enclosed in the sheathing is in the compacted state.

11. The cored wire of claim 10, characterised in that the sheathing has at least two parallel flattened zones facing one another.

* * * * *